US010024264B2

(12) United States Patent
Denk

(10) Patent No.: US 10,024,264 B2
(45) Date of Patent: Jul. 17, 2018

(54) DETERMINATION OF THE POINT IN TIME OF A PREDETERMINED OPEN STATE OF A FUEL INJECTOR

(71) Applicant: Continental Automotive GmbH, Hannover (DE)

(72) Inventor: Frank Denk, Obertraubling (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 64 days.

(21) Appl. No.: 14/905,908

(22) PCT Filed: Jun. 26, 2014

(86) PCT No.: PCT/EP2014/063609
§ 371 (c)(1),
(2) Date: Jan. 18, 2016

(87) PCT Pub. No.: WO2015/010851
PCT Pub. Date: Jan. 29, 2015

(65) Prior Publication Data

US 2016/0160784 A1 Jun. 9, 2016

(30) Foreign Application Priority Data

Jul. 24, 2013 (DE) ..... 10 2013 214 412

(51) Int. Cl.
*F02D 19/02* (2006.01)
*F02D 41/24* (2006.01)
(Continued)

(52) U.S. Cl.
CPC ..... *F02D 41/2467* (2013.01); *F02D 41/20* (2013.01); *H01F 7/1844* (2013.01);
(Continued)

(58) Field of Classification Search
CPC ..... F02D 41/2467; F02D 41/20; F02D 2041/2013; F02D 2041/2055;
(Continued)

(56) References Cited

U.S. PATENT DOCUMENTS 5,020,362 A 6/1991 Hart et al. ..... 73/114.43
5,947,090 A * 9/1999 Maeda ..... F02D 41/20 123/490

(Continued)

FOREIGN PATENT DOCUMENTS

CN 102027221 A 4/2011 ..... F02D 41/00
CN 103168165 A 6/2013 ..... F02M 59/46

(Continued)

OTHER PUBLICATIONS

German Office Action, Application No. 102013214412.1, 5 pages, dated Mar. 21, 2014.

(Continued)

*Primary Examiner* — Hai Huynh
*Assistant Examiner* — Gonzalo Laguarda
(74) *Attorney, Agent, or Firm* — Slayden Grubert Beard PLLC

(57) ABSTRACT

A method is provided for determining the point in time of a predetermined open state (e.g., start or stop time of an opening or closing process) of a fuel injector having a coil drive for an internal combustion engine of a motor vehicle. The method includes applying a first voltage pulse to the magnetic coil drive of the fuel injector, detecting a first temporal progression of the current intensity of a current flowing through the coil drive, applying a second voltage pulse to the magnetic coil drive of the fuel injector, detecting a second temporal progression of the current intensity of the current flowing through the coil drive, determining a differential progression based on the first and second temporal
(Continued)

progressions of the current intensity, and determining a point in time at which the differential progression exhibits an extremum, which corresponds with the point in time of the predetermined open state.

15 Claims, 1 Drawing Sheet

(51) Int. Cl.
*F02D 41/20* (2006.01)
*H01F 7/18* (2006.01)
*F02M 35/12* (2006.01)

(52) U.S. Cl.
CPC ..... *F02D 2041/2013* (2013.01); *F02D 2041/2055* (2013.01); *F02D 2041/2058* (2013.01); *F02D 2200/063* (2013.01); *F02M 35/1294* (2013.01)

(58) Field of Classification Search
CPC ..... F02D 2041/2058; F02D 2200/063; F02D 41/2096; F02D 2041/2051; H01F 7/1844
USPC ..... 701/105; 123/490, 497
See application file for complete search history.

(56) References Cited

U.S. PATENT DOCUMENTS

| | | | | |
|---|---|---|---|---|
| 6,949,923 | B2 | 9/2005 | Schultz et al. | 324/207.18 |
| 7,413,160 | B2 | 8/2008 | Beilharz et al. | 251/30.01 |
| 8,714,140 | B2 | 5/2014 | Borchsenius et al. | 123/494 |
| 9,316,478 | B2 | 4/2016 | Wirkowski et al. | |
| 9,329,101 | B2 * | 5/2016 | Frohlich | F02D 41/20 |
| 2002/0117152 | A1 | 8/2002 | Fallahi et al. | 123/490 |
| 2008/0148831 | A1 | 6/2008 | Kekedjian et al. | 73/116.01 |
| 2011/0023836 | A1 * | 2/2011 | Verner | F02D 41/20 123/490 |
| 2012/0296551 | A1 | 11/2012 | Kabasin | 701/103 |
| 2013/0073188 | A1 * | 3/2013 | Rosel | F02D 41/20 701/105 |
| 2014/0092516 | A1 | 4/2014 | Koch et al. | 361/160 |
| 2014/0095052 | A1 | 4/2014 | Frohlich et al. | 701/103 |

FOREIGN PATENT DOCUMENTS

| | | | | |
|---|---|---|---|---|
| DE | 10150199 | A1 | 4/2003 | H01F 7/18 |
| DE | 102004020937 | A1 | 11/2005 | F02D 41/20 |
| DE | 10356858 | B4 | 4/2007 | F02D 41/20 |
| DE | 102010027806 | A1 | 10/2011 | F02D 41/20 |
| DE | 102010063009 | A1 | 6/2012 | F02D 41/34 |
| DE | 102011005672 | A1 | 9/2012 | F02D 41/20 |
| JP | 2008128206 | A | 6/2008 | F02D 41/14 |
| JP | 2012127277 | A | 7/2012 | F02D 41/04 |
| WO | 2012/167290 | A1 | 12/2012 | F02D 41/22 |
| WO | 2012/159877 | A3 | 3/2013 | F02D 41/20 |
| WO | 2015/010851 | A1 | 1/2015 | F02D 41/20 |

OTHER PUBLICATIONS

International Search Report and Written Opinion, Application No. PCT/EP2014/063609, 20 pages, dated Sep. 12, 2014.
Korean Office Action, Application No. 2017035847887, 9 pages, dated May 23, 2017.
Chinese Office Action, Application No. 201480041786.X, 13 pages, dated Jun. 23, 2017.
Chinese Office Action, Application No. 201480041786.X, 14 pages, dated Dec. 1, 2017.
Korean Notice of Allowance, Application No. 2017091095020, 3 pages, dated Dec. 29, 2017.

* cited by examiner

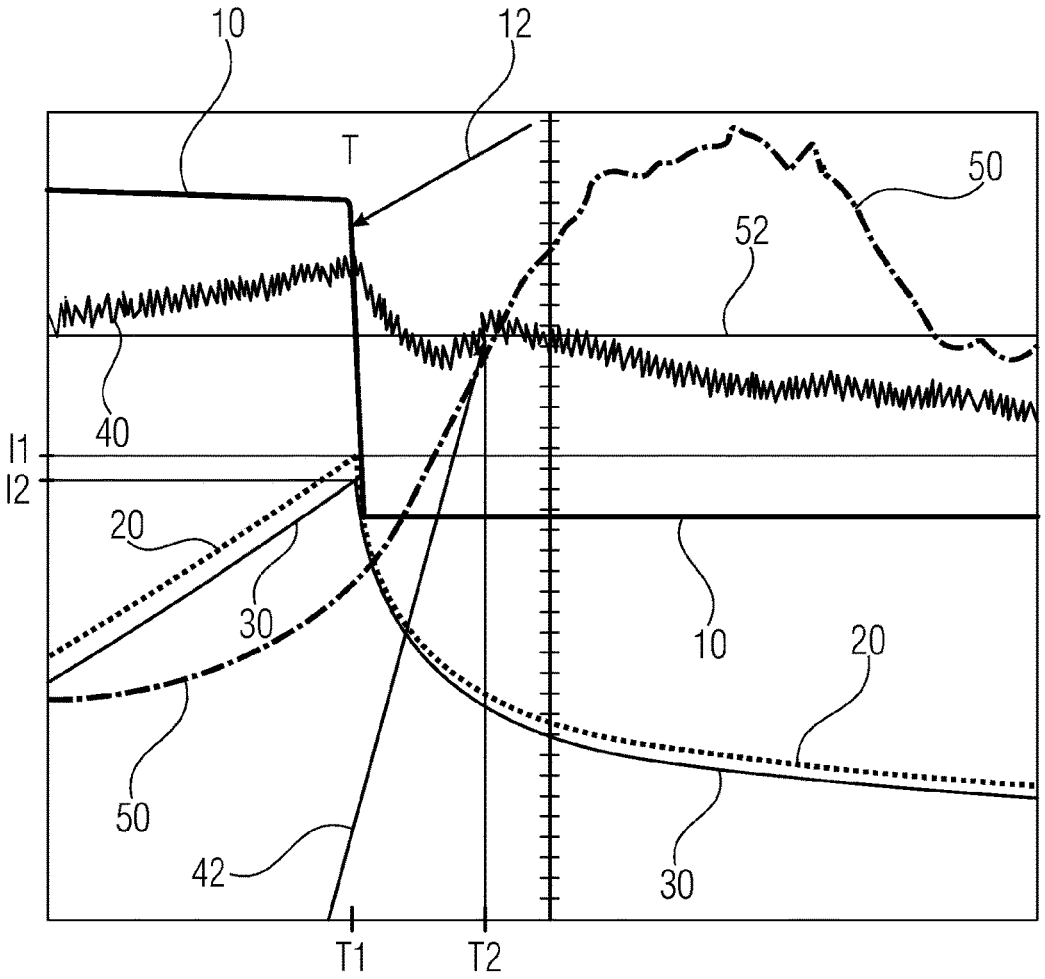
10
12
T
50
52
40
I1
I2
20
30
10
20
50
42
30
T1
T2

DETERMINATION OF THE POINT IN TIME OF A PREDETERMINED OPEN STATE OF A FUEL INJECTOR

CROSS-REFERENCE TO RELATED APPLICATIONS

This application is a U.S. National Stage Application of International Application No. PCT/EP2014/063609 filed Jun. 26, 2014, which designates the United States of America, and claims priority to DE Application No. 10 2013 214 412.1 filed Jul. 24, 2013, the contents of which are hereby incorporated by reference in their entirety.

TECHNICAL FIELD

The present invention concerns the technical field of the activation of fuel injectors. The present invention concerns in particular a method for determining the point in time of a predefined open state of a fuel injector for an internal combustion engine of a motor vehicle comprising a coil drive. The present invention further concerns a suitable apparatus, an engine controller as well as a computer program for determining the point in time of a predefined open state of a fuel injector comprising a coil drive.

BACKGROUND

When operating fuel injectors with a coil drive, different opening and closing timing behaviors of individual injectors, and thus variations in the respective injection amounts, occur owing to electrical, magnetic, mechanical and hydraulic tolerances.

The relative injection quantity differences from injector to injector increase as injection times become shorter. Previously, said relative differences in quantity were small and without practical significance. The developments towards smaller injection quantities and shorter injection times, however, result in the influence of the relative differences in quantity no longer being able to be disregarded.

SUMMARY

One embodiment provides a method for determining the point in time of a predefined open state of a fuel injector comprising a coil drive for an internal combustion engine of a motor vehicle, the method involving subjecting the magnetic coil drive of the fuel injector to a first voltage pulse, recording a first time profile of the current level of a current flowing through the coil drive, subjecting the magnetic coil drive of the fuel injector to a second voltage pulse, recording a second time profile of the current level of the current flowing through the coil drive, determining a difference profile based on the recorded first time profile of the current level and the recorded second time profile of the current level, and determining a point in time at which the difference profile has an extreme value, wherein the determined point in time is the point in time of the predefined open state.

In a further embodiment, the first voltage pulse ends at a first point in time, at which the current level of the current flowing through the coil drive has reached a first maximum value, and the second voltage pulse ends at a second point in time, at which the current level of the current flowing through the coil drive has reached a second maximum value.

In a further embodiment, the difference between the first maximum value and the second maximum value is between 0.1 A and 1 A.

In a further embodiment, when determining the difference profile, the first time profile of the current level and the second time profile of the current level are synchronized with each other based on the first point in time and the second point in time.

In a further embodiment, the first time profile of the current level and the second time profile of the current level are recorded by digital sampling with a sampling rate in the range 0.5 μs to 5 μs.

In a further embodiment, the determined point in time of the predefined open state of the fuel injector is a start or end point in time of an opening or closing process of the fuel injector.

Another embodiment provides a method for activating a fuel injector comprising a coil drive for an internal combustion engine of a motor vehicle, the method including determining the point in time of a predefined open state of the fuel injector by using any of the methods disclosed above, determining a difference between the determined point in time and a reference point in time, and activating the fuel injector, wherein the coil drive is subjected to a voltage pulse, the starting time and/or duration of which is/are determined based on the determined difference.

Another embodiment provides an apparatus for determining the point in time of a predefined open state of a fuel injector comprising a coil drive for an internal combustion engine of a motor vehicle, the apparatus comprising: an application unit that is configured to subject the magnetic coil drive of the fuel injector to a first voltage pulse, and subject the magnetic coil drive of the fuel injector to a second voltage pulse; a recording unit that is configured to record a first time profile of the current level of a current flowing through the coil drive, and record a second time profile of the current level of the current flowing through the coil drive; a determination unit for determining a difference profile based on the recorded first time profile of the current level and the recorded second time profile of the current level; and a detecting unit for determining a point in time at which the difference profile has an extreme value, wherein the determined point in time is the point in time of the predefined open state.

Another embodiment provides an engine controller for an internal combustion engine of a motor vehicle, wherein the engine controller is arranged to perform any of the methods disclosed above.

Another embodiment provides a computer program for determining the point in time of a predetermined open state of a fuel injector comprising a coil drive for an internal combustion engine of a motor vehicle, wherein the computer program is stored in non-transitory computer-readable media and executable by a processor to perform any of the methods disclosed above.

BRIEF DESCRIPTION OF THE DRAWINGS

Example features of the present invention are discussed below with reference to the FIG. 1, which shows a voltage profile, a needle lift, two coil current profiles and a difference profile for a fuel injector as functions of time in connection with an example embodiment of the present invention.

DETAILED DESCRIPTION

Embodiments of the present invention provide an improved activation of fuel injectors that can effectively compensate the relative injection quantity differences that are due to tolerances.

Some embodiments of the invention provide a method for determining the point in time of a predefined open state of a fuel injector comprising a coil drive for an internal combustion engine of a motor vehicle. The described method comprises the following: (a) subjecting the magnetic coil drive of the fuel injector to a first voltage pulse, (b) recording a first time profile of the current level of a current flowing through the coil drive, (c) subjecting the magnetic coil drive of the fuel injector to a second voltage pulse, (d) recording a second time profile of the current level of the current flowing through the coil drive, (e) determining a difference profile based on the recorded first time profile of the current level and the recorded second time profile of the current level, and (f) determining a point in time at which the difference profile has an extreme value, wherein the determined point in time is the point in time of the predefined open state.

The described method is based on the knowledge that the time profile of the current level during an opening process of the fuel injector (in which the coil drive is subjected to a voltage pulse (boost voltage)) depends on the inductance of the coil drive. In addition to the varying intrinsic inductance of the coil drive (owing to the non-linear ferromagnetic magnet material), a component of motional inductance occurs because of the armature displacement. The motional inductance component starts with the start of the opening phase (armature/needle displacement starts) and ends at the end of the opening phase (armature/needle displacement ends). If said injector is now operated with two slightly different current profiles, the currents of which behave magnetically similarly, the current profile will also change owing to the altered inductive influences but will be similar. With the described method the analysis of strong current gradients (also voltage gradients) can consequently be simplified, because owing to the similarity of the profiles said strong gradients are cancelled out or are at least reduced and the relatively small changes that are caused by the armature displacement now form an extreme value following the difference formation.

In this document "first voltage pulse" and "second voltage pulse" refer in particular to so-called boost voltage pulses that are suitable for opening the fuel injector within a short time.

After being subjected to the respective voltage pulses, the injector is preferably held open for some time during an injection phase.

The recording of the (first and second) time profiles of the current level is preferably carried out both during the application of the respective voltage pulse (i.e. during the boost phase) and also thereafter (i.e. during the injection phase and/or closing phase).

In this document "extreme value" refers in particular to a local or global maximum or minimum of the difference profile as a function of time.

The determination of the point in time at which the difference profile has an extreme value can in particular be carried out using a numerical method.

The point in time of the predefined open state of the fuel injector can now be determined by determining the point in time at which the difference profile has an extreme value. By comparing the determined point in time with a predetermined point in time, i.e. a point in time at which the predefined open state should ideally be reached, deviations from an ideal opening profile of the fuel injector can be detected and possibly compensated.

According to one embodiment of the invention, the first voltage pulse ends at a first time at which the current level of the current flowing through the coil drive has reached a first maximum value, and the second voltage pulse ends at a second time at which the current level of the current flowing through the coil drive has reached a second maximum value.

In other words, the two recorded time profiles of the current level differ in that they have different maximum values (also known as peak currents).

According to a further embodiment of the invention, the difference between the first maximum value and the second maximum value lies between about 0.1 A and about 1 A, in particular between about 0.2 A and about 0.8 A, in particular between about 0.3 A and about 0.7 A, in particular between about 0.4 A and about 0.6 A, in particular about 0.5 A.

The difference between the first and second maximum values is in other words relatively small compared to a typical peak current of about 11 Amperes. Performing the two current applications thus requires only slight changes of the settings when subjecting the magnetic coil drive to the first and second voltage pulses.

According to a further embodiment of the invention, the first time profile of the current level and the second time profile of the current level are synchronized with each other based on the first point in time and the second point in time when determining the difference profile.

In other words, the first and second points in time are each used as a synchronization point (or common point) between the first time profile of the current level and the second time profile of the current level when determining the difference profile.

According to a further embodiment of the invention, the first time profile of the current level and the second time profile of the current level are recorded by digital sampling with a sampling rate in the range from 0.5 μs to 5 μs.

The digital sampling enables the storage and subsequent processing of accurate representations of the first and second time profiles.

According to a further embodiment of the invention, the determined point in time of the predefined open state of the fuel injector is a start or end point in time of an opening or closing process of the fuel injector.

In this document, "opening process of the fuel injector" in particular refers to a process that starts at the point in time at which the closed fuel injector starts to open because of the current flowing through the coil drive and ends at the point in time at which the fuel injector is fully open.

In this document, "closing process of the fuel injector" in particular refers to a process that starts at the point in time at which the opened fuel injector starts to close because the current flowing through the coil drive is switched off and ends at the point in time at which the fuel injector is again completely closed.

By determining the starting point in time and the end point in time of the opening process or closing process, it can be determined whether the opening process or closing process is proceeding in the envisaged manner. Should this not be the case, for example because of tolerance-related deviations in electrical, magnetic, mechanical and hydraulic parameters of the fuel injector, the profile can be compensated in order to prevent a deviation from the envisaged injection quantities.

Other embodiments of the invention provide a method for activating a fuel injector comprising a coil drive for an internal combustion engine of a motor vehicle. The described method includes the following: (a) determining the point in time of a predefined open state of the fuel injector by using the method according to the first aspect or one of the above exemplary embodiments, (b) determining a difference between the determined point in time and a reference point in time, and (c) activating the fuel injector, wherein the coil drive is subjected to a voltage pulse, the starting time and/or duration of which is/are determined based on the determined difference.

The described method is based on the idea that activating the fuel injector can be adapted based on the determined difference between the determined point in time and a reference point in time such that deviations in the injection quantities can be minimized.

In this document, "reference point in time" in particular refers to a point in time at which the predefined open state of the fuel injector should occur in the ideal case. The determined difference between the determined point in time and the reference point in time thus constitutes a measure of how much the point in time of the actual occurrence of the predefined open state deviates from the ideal or target point in time.

If for example it is determined that the start of the opening process is shifted in time, the starting time of the voltage pulse to which the coil drive is subjected can be shifted accordingly.

If for example it is determined that the end of the opening process is shifted in time, the duration of injection can be adapted in order to ensure that the envisaged amount of fuel is injected. In other words, the duration of the voltage pulse can be extended in the case of a delayed opening of the fuel injector in order to prevent too little fuel from being injected. In a similar manner, the duration of the voltage pulse can be reduced in the case of a premature opening of the fuel injector in order to prevent too much fuel from being injected.

The aforementioned corrections can be carried out advantageously for individual pulses, i.e. for each individual opening process.

The corrections or time displacements can take into account the other physical system parameters, such as for example fuel temperature, time since previous injection process etc. This can be carried out by using suitable pilot control characteristics or fields or a model for example.

Other embodiments of the invention provide an apparatus for determining the point in time of a predefined open state of a fuel injector comprising a coil drive for an internal combustion engine of a motor vehicle. The described apparatus comprises the following: a) an application unit that is configured to: (a1) subject the magnetic coil drive of the fuel injector to a first voltage pulse, and (a2) subject the magnetic coil drive of the fuel injector to a second voltage pulse; (b) a recording unit that is configured to: (b1) record a first time profile of the current level of a current flowing through the coil drive, and (b2) record a second time profile of the current level of the current flowing through the coil drive; (c) a determination unit for determining a difference profile based on the recorded first time profile of the current level and the recorded second time profile of the current level; and (d) a detecting unit for determining a point in time at which the difference profile has an extreme value, wherein the determined point in time is the point in time of the predefined open state.

The described apparatus is based on the same knowledge as described above in connection with the first and second aspects.

In one exemplary embodiment, the recording unit comprises for example a FADC (Fast Analog-to-Digital Converter) that is suitable for recording the coil current of the respective currently operated fuel injector.

The determination unit and detecting unit can advantageously be implemented with the use of a microprocessor system that can implement the necessary mathematical operations in order to determine the difference profile and extreme values. The system can also comprise a memory unit that is arranged to store reference current profiles, pilot control characteristics, models etc.

The apparatus can determine the start and end times of an opening process in a simple manner, so that the activation of the respective fuel injectors can be adjusted such that relative injection quantity differences can be minimized.

Other embodiments of the invention provide an engine controller for a vehicle. The described engine controller is arranged to carry out the method according to the first or second aspect or one of the above exemplary embodiments.

Said engine controller enables variations in the injection quantities for a plurality of fuel injectors to be minimized with simple and inexpensive means.

Other embodiments of the invention provide a computer program for determining the point in time of a predefined open state of a fuel injector comprising a coil drive for an internal combustion engine of a motor vehicle. The described computer program is arranged to carry out the method according to the first or second aspect or one of the above exemplary embodiments if it is executed by a processor or microcontroller.

For the purposes of this document, the designation of such a computer program is equivalent to the concept of a program element, of a computer program product and/or of a computer-readable medium containing the instructions for controlling a computer system in order to coordinate the operation of a system or of a process in a suitable manner to achieve the effects associated with the method according to the invention.

The computer program can be implemented as a computer-readable instruction code in any suitable programming language, such as for example in Assembler, JAVA, C++ etc. The computer program can be stored on a computer-readable memory medium (CD-ROM, DVD, Blu-ray Disc, removable drive, volatile or non-volatile memory, integral memory/processor etc.). The instruction code can program a computer or other programmable device, such as in particular a controller for an engine of a motor vehicle, such that the target functions are carried out. Further, the computer program can be provided in a network such as for example the Internet, from which it can be downloaded as required by a user.

Embodiments of the invention can be implemented both by means of a computer program, i.e. software, and also by means of one or more special electrical circuits, i.e. in hardware or in any hybrid form, i.e. by means of software components and hardware components.

It is noted that embodiments of the invention have been described with reference to different subject matter of the invention. In particular, some embodiments of the invention are described with method claims and other embodiments of the invention are described with apparatus claims. However, it will be immediately clear to the person skilled in the art on reading this application that, unless specifically stated otherwise, in addition to a combination of features belonging to one type of subject matter of the invention, any combination of features that belong to different types of subject matter of the invention is also possible.

It is noted that the embodiment described below only represents a limited selection of possible embodiment versions of the invention.

FIG. 1 shows a voltage profile 10, a first current profile 20, a second current profile 30, a difference profile 40 as well as a needle lift profile 50 for a fuel injector as functions of time according to an exemplary embodiment. It should be noted that the first current profile 30 was recorded during a first opening process of the fuel injector and the second current profile 40 was recorded during a second opening process of the fuel injector and the profiles were then synchronized. The voltage profile 10 and the needle lift profile 50 are essentially identical for the two opening processes.

The left third of the FIGURE (up to the point in time T1) shows the end of a boost phase, in which the voltage 10 is adjusted to the boost voltage of for example 65 V. At the point in time T1, as marked by the arrow 12, the boost phase is ended by switching off the boost voltage and the voltage 10 rapidly falls to a lower value (the so-called holding voltage, e.g. the 12 V vehicle electrical system voltage). The fuel injector needle lift 50 rises both during the indicated end of the boost phase and also for some time thereafter and exceeds the line 52 representing the needle lift in the open state (during the subsequent injection phase), i.e. the needle lift after the end of a brief transient phase.

The first opening process differs from the second in that the boost voltage in the first opening process is switched off when the coil current 20 has reached a first maximum value (first peak current) I1 and the boost voltage in the second opening process is switched off when the coil current 30 has reached a second slightly lower maximum value (second peak current) I2.

The two current profiles 20 and 30 are sampled, stored and then synchronized using the respective points in time (T1) of boost voltage switch-off. The current profiles 20 and 30 shown in FIG. 1 are synchronized. Following the synchronization, a difference profile 40 is calculated by subtraction of the second current profile 30 from the first current profile 20. The difference profile 40 is then analyzed using numerical methods in order to determine points in time (relative to the common synchronization point in time T1) at which the difference profile 40 has an extreme value (maximum value or minimum value).

The difference profile 40 shown in FIG. 1 shows a first maximum at the point in time T1 and a second maximum at the point in time T2. Furthermore, the difference profile has a minimum between T1 and T2. As also marked by the arrow 42, the second (local) maximum occurs at about the same point in time at which the needle lift 50 exceeds the line 52 for the first time, i.e. at the point in time at which the fuel injector has reached its open state. In other words, the point in time that corresponds to the end of the opening phase for the fuel injector can be determined by determining the point in time T2, i.e. the point in time at which the difference profile has a second maximum.

The determination of the point in time T2 now enables a correction of the activation if said point in time T2 deviates from the predetermined value, so that it can be ensured that the injection quantity is the same as the predetermined quantity. If it is determined that T2 is too small (opening process ends too early) or too large (opening process ends too late), this can be compensated by a corresponding shortening or extension of the injection duration.

As a result, it can be achieved that every fuel injector provides the predefined injection quantity with greater accuracy per injection process, so that no or only very small relative differences in quantity can occur between the injectors.

The necessary compensation is carried out in a simple manner by extending or shortening the injection duration. As a consequence, no changes in the current profiles are necessary during the opening and closing processes.

REFERENCE CHARACTER LIST

10 voltage profile
12 arrow
20 first current profile
22 maximum
30 second current profile
32 maximum
40 difference profile
42 arrow
50 needle lift profile
52 line
T1 point in time
T2 point in time
I1 first maximum value
I2 second maximum value

What is claimed is:

1. A method for determining a point in time of a predefined event associated with a predefined open state of a fuel injector comprising a magnetic coil drive for an internal combustion engine of a motor vehicle, the method comprising:

applying a first voltage pulse to the magnetic coil drive of the fuel injector, the first voltage pulse including a boost voltage level applied for a first time T1, recording a first time profile of a current level of a current flowing through the coil drive in response to the first voltage pulse, applying a second voltage pulse to the magnetic coil drive of the fuel injector to a second voltage pulse, the second voltage pulse including the boost voltage level applied for the first time T1, recording a second time profile of a current level of the current flowing through the coil drive in response to the second voltage pulse, determining a difference profile based on the recorded first time profile of the current level and the recorded second time profile of the current level, determining a point in time T2 corresponding to a second peak value, T2 following an absolute maximum occurring near time T1 and further following an inflection value of a general trend of the difference profile from reducing to increasing using numerical methods, identifying the determined point in time T2 as the point in time of the predefined event associated with the predefined open state of the fuel injector, and activating the fuel injector based on the determined point in time.

2. The method of claim 1, wherein:

the first voltage pulse ends at a first point in time, at which the current level of the current flowing through the magnetic coil drive reaches a first maximum value of the current, and the second voltage pulse ends at a second point in time, at which the current level of the current flowing through the magnetic coil drive reaches a second maximum value of the current.

3. The method of claim 2, wherein a difference between the first maximum value of the current and the second maximum value of the current is between 0.1 A and 1 A.

4. The method of claim 2, wherein determining the difference profile comprises synchronizing the first time profile of the current level and the second time profile of the current level with each other based on the first point in time and the second point in time.

5. The method of claim 1, wherein the first time profile of the current level and the second time profile of the current level are recorded by digital sampling with a sampling rate in the range 0.5 μs to 5 μs.

6. The method of claim 1, wherein the determined point in time of the predefined event associated with the predefined open state of the fuel injector is a start time or an end time of an opening or closing process of the fuel injector.

7. The method of claim 1, wherein activating the fuel injector based on the determined point in time comprises:

determining a difference between the determined point in time and a reference point in time, determining a timing for a voltage pulse based on the determined difference, the determined timing defining at least one of a start time and a duration for the voltage pulse, and applying the voltage pulse to the magnetic coil drive according to the determined timing for the voltage pulse.

8. An apparatus for determining a point in time of a predefined event associated with a predefined open state of a fuel injector comprising a magnetic coil drive for an internal combustion engine of a motor vehicle, the apparatus comprising:

a voltage source operable to:

apply a first voltage pulse to the magnetic coil drive of the fuel injector, the first voltage pulse including a boost voltage level applied for a first time T1, and apply a second voltage pulse to the magnetic coil drive of the fuel injector the second voltage pulse including the boost voltage level applied for the first time T1;

a recording unit configured to:

record a first time profile of a current level of a current flowing through the magnetic coil drive in response to the first voltage pulse, and record a second time profile of a current level of the current flowing through the magnetic coil drive in response to the second voltage pulse;

a determination unit configured to determine a difference profile based on the recorded first time profile of the current level and the recorded second time profile of the current level; and a detecting unit configured to determine a point in time T2 corresponding to a second peak value, T2 following an absolute maximum occurring near time T1 and further following an inflection value of a general trend of the difference profile from reducing to increasing using numerical methods, wherein the determined point in time is the point in time of the predefined event associated with the predefined open state of the fuel injector, and an engine controller configured to activate the fuel injector based on the determined point in time.

9. The apparatus of claim 8, wherein:

the first voltage pulse ends at a first point in time, at which the current level of the current flowing through the magnetic coil drive reaches a first maximum value, and the second voltage pulse ends at a second point in time, at which the current level of the current flowing through the magnetic coil drive reaches a second maximum value.

10. The apparatus of claim 9, wherein a difference between the first maximum value and the second maximum value is between 0.1 A and 1 A.

11. The apparatus of claim 9, wherein determining the difference profile comprises synchronizing the first time profile of the current level and the second time profile of the current level with each other based on the first point in time and the second point in time.

12. The apparatus of claim 8, wherein the first time profile of the current level and the second time profile of the current level are recorded by digital sampling with a sampling rate in the range 0.5 μs to 5 μs.

13. The apparatus of claim 8, wherein the determined point in time of the predefined event associated with the predefined open state of the fuel injector is a start time or an end time of an opening or closing process of the fuel injector.

14. The apparatus of claim 8, wherein activating the fuel injector based on the determined point in time comprises:

determining a difference between the determined point in time and a reference point in time, determining a timing for a voltage pulse based on the determined difference, the determined timing defining at least one of a start time and a duration for the voltage pulse, and applying the voltage pulse to the magnetic coil drive according to the determined timing for the voltage pulse.

15. An engine controller for an internal combustion engine of a motor vehicle, wherein the engine controller comprises a processor computer instructions stored in non-transitory computer-readable media and executable by the processor to:

apply a first voltage pulse to a magnetic coil drive of the fuel injector, the first voltage pulse including a boost voltage level applied for a first time T1, record a first time profile of a current level of a current flowing through the magnetic coil drive in response to the first voltage pulse, apply a second voltage pulse to the magnetic coil drive of the fuel injector to a second voltage pulse, the second voltage pulse including the boost voltage level applied for the first time T1, record a second time profile of a current level of the current flowing through the magnetic coil drive in response to the second voltage pulse, determine a difference profile based on the recorded first time profile of the current level and the recorded second time profile of the current level, determine a point in time T2 corresponding to a second peak value, T2 following an absolute maximum occurring near time T1 and further following an inflection value of a general trend of the difference profile from reducing to increasing using numerical methods, wherein the determined point in time is the point in time of the predefined event associated with the predefined open state of the fuel injector, and activate the fuel injector based on the determined point in time.

* * * * *